United States Patent [19]

Grover

[11] Patent Number: 4,528,108

[45] Date of Patent: Jul. 9, 1985

[54] METHOD FOR COOLING INTERNAL COMBUSTION ENGINE WITH AN OLEAGINOUS COOLANT FLUID COMPOSITION

[75] Inventor: Kent B. Grover, Chardon, Ohio

[73] Assignee: The Lubrizol Corporation, Ohio

[21] Appl. No.: 486,639

[22] Filed: Apr. 20, 1983

[51] Int. Cl.[3] ..... C09K 5/00

[52] U.S. Cl. ..... 252/75; 252/32.7 E; 252/33.4; 123/41.42

[58] Field of Search ..... 252/32.7 E, 33.4, 75; 123/41.42

[56] References Cited

U.S. PATENT DOCUMENTS

| | | | |
|---|---|---|---|
| 774,752 | 11/1904 | Hart | 123/41.42 |
| 877,903 | 2/1908 | Butler | 237/12.1 |
| 1,138,824 | 5/1915 | Wills | 123/557 |
| 1,276,846 | 8/1918 | White | 184/6.8 |
| 1,384,234 | 7/1921 | Cameron | 184/104 R |
| 1,420,684 | 6/1922 | Bradshaw | 123/41.42 |
| 1,480,402 | 1/1924 | Krollage | 123/41.42 |
| 1,551,356 | 8/1925 | Wolf | 123/41.42 |
| 1,553,156 | 9/1925 | Hart | 123/41.42 |
| 1,649,246 | 11/1927 | Morrisey | 123/41.42 |
| 1,672,003 | 6/1928 | Smith | 123/41.41 |
| 1,749,683 | 3/1930 | Windhoff | 123/41.42 |
| 1,802,744 | 4/1931 | Wales | 123/41.42 |
| 1,980,811 | 11/1934 | Ljungstrom | 123/174 |
| 2,020,089 | 11/1935 | Weed | 123/11 |
| 2,029,602 | 2/1936 | Andersson | 123/173 |
| 2,078,499 | 4/1937 | Ljungstrom | 123/170 |
| 2,085,810 | 7/1937 | Ljungstrom | 123/41.42 |
| 2,129,846 | 9/1938 | Knochenhauer | 123/174 |
| 2,376,683 | 5/1945 | Gill | 123/174 |
| 2,387,485 | 10/1945 | Young | 257/2 |
| 2,537,694 | 1/1951 | Oaks | 123/41.1 |
| 2,580,572 | 1/1952 | McMillian | 123/32 |
| 2,725,044 | 11/1955 | Doyle | 123/41.19 |
| 3,421,825 | 1/1969 | Maycock | 431/208 |
| 3,652,410 | 3/1972 | Hollinghurst et al. | 252/32.7 E |
| 3,687,232 | 8/1972 | Stenger | 184/6.8 |
| 4,179,389 | 12/1979 | Mann | 252/32.7 E |
| 4,263,150 | 4/1981 | Clason et al. | 252/32.7 E |
| 4,282,106 | 8/1981 | Schaap et al. | 252/32.7 E |

*Primary Examiner*—Paul Lieberman
*Assistant Examiner*—Robert A. Wax
*Attorney, Agent, or Firm*—Denis A. Polyn; Walter C. Danison, Jr.

[57] ABSTRACT

Disclosed is a method for cooling an internal combustion engine which comprises circulating within the cooling system of said engine an oleaginous coolant fluid composition which comprises (A) a major amount of a lubricating oil having a kinematic viscosity of from about 3.5 up to about 5 cSt at 100° C. and from about 18 up to about 30 cSt at 40° C.; and (B) a minor amount of one or more of the following compositions:

(1) one or more basic metal salts of organic acids;

(2) one or more phosphorus-containing metal salts;

(3) one or more phenol antioxidants.

17 Claims, No Drawings

METHOD FOR COOLING INTERNAL COMBUSTION ENGINE WITH AN OLEAGINOUS COOLANT FLUID COMPOSITION

FIELD OF THE INVENTION

This invention relates to a method for cooling an internal combustion engine which comprises circulating within the cooling system of said engine an oleaginous coolant fluid composition. Additionally, this invention relates to a cooling system for an internal combustion engine wherein said cooling system of said engine contains an oleaginous coolant fluid composition.

BACKGROUND OF THE INVENTION

It is well known that most internal combusion engines have a cooling system in which excess heat generated during the operation of the engine is removed by circulating a coolant fluid through the cooling system of such an engine. Generally, water containing various materials is the coolant fluid used for this purpose.

A suitable coolant fluid must meet the following basic requirements:

1. Provide adequate heat transfer.
2. Provide a corrosion-resistant environment within the cooling system.
3. Prevent formation of scale or sludge deposits in the cooling system.
4. Be compatible with the cooling system hose and seal materials.
5. Provide adequate freeze protection during cold weather operation.

Oil-based coolants provide several advantages over the conventional aqueous coolants. These advantages include 1. Reduction in expensive engine rebuild due to leakage of coolant into the crankcase;
2. Longer engine life;
3. Eliminate the need for supplemental coolant corrosion inhibitor and expensive filters;
4. Faster engine warm-up; and
5. Increased horsepower output.

Therefore, it is the object of this invention to provide a novel method for cooling an internal combustion engine which comprises circulating within the cooling system of said engine an oleaginous coolant fluid composition.

Another object is to provide a novel cooling system for an internal combustion engine wherein said cooling system contains an oleaginous coolant fluid composition.

These and other objects of the invention are accomplished by providing a method for cooling an internal combustion engine which comprises circulating within the cooling system of said engine an oleaginous coolant fluid composition comprising:

(A) a major amount of a lubricating oil having a kinematic viscosity of from about 3.5 up to about 5 cSt at 100° C. and from about 18 up to about 30 cSt at 40° C.;

(B) a minor amount of a composition selected from the group consisting of (1) one or more basic metal salts of organic acids;
(2) one or more phosphorus containing metal salts;
(3) one or more phenolic antioxidants;
(4) one or more pour point depressants; and mixtures of two or more of (B)(1) through (B)(4).

In another embodiment, the objects of this invention are accomplished by providing a cooling system of an internal combustion engine which contains within said cooling system of said engine the oleaginous coolant fluid composition described hereinabove.

Component (A) of the oleaginous coolant fluid composition useful for the purposes of this invention is a lubricating oil having a kinematic viscosity of from about 3.5 to about 5 centistokes (cSt), preferably about 4.0–4.3 cSt, at 100° C. and from about 18 up to about 30 cSt, preferably 19–22 cSt, at 40° C. The standard method for determining kinematic viscosity is by ASTM D445 test procedure.

The lubricating oils useful as Component (A) include natural and synthetic lubricating oils and mixtures thereof.

Natural oils include animal oils and vegetable oils (e.g., castor, lard oil) liquid petroleum oils and solvent-treated or acid-treated mineral lubricating oils of the paraffinic, naphthenic and mixed paraffinic-naphthenic types. Oils of lubricating viscosity derived from coal or shale are also useful base oils.

Synthetic lubricating oils include hydrocarbon oils and halo-substituted hydrocarbon oils such as polymerized and interpolymerized olefins [e.g., polybutylenes, polypropylenes, propylene-isobutylene copolymers, chlorinated polybutylenes, poly(1-hexenes), poly(1-octenes), poly(1-decenes)]; alkylbenzenes [e.g., dodecylbenzenes, tetradecylbenzenes, dinonylbenzenes, di(2-ethylhexyl)benzenes]; polyphenyls (e.g., biphenyls, terphenyls, alkylated polyphenols); and alkylated diphenyl ethers and alkylated diphenyl sulfides and the derivatives, analogs and homologs thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, the alkyl and aryl ethers of these polyoxyalkylene polymers (e.g., methyl-polyisopropylene glycol ether having an average molecular weight of 1000, diphenyl ether of polyethylene glycol having a molecular weight of 500–1000, diethyl ether of polypropylene glycol having a molecular weight of 1000–1500); and mono- and polycarboxylic esters thereof, for example, the acetic acid esters, mixed $C_3$–$C_8$ fatty acid esters and $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebacic acid, furmaric acid, adipic acid, linoleic acid dimer, malonic acid, alkyl malonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol and tripentaerythritol.

Silicon-based oils such as the polyalkyl-, polyaryl-, polyalkoxy-, or polyaryloxysiloxane oils and silicate oils comprise another useful class of synthetic lubricants; they include tetraethyl silicate, tetraisopropyl silicate, tetra-(2-ethylhexyl) silicate, tetra-(4-methyl-2-ethylhexyl) silicate, tetra-(p-tert-butylpentyl) silicate, hexa-(4-methyl-2-pentoxy)disiloxane, poly(methyl)siloxanes and poly(methylphenyl)siloxanes. Other synthetic lubricating oils include liquid esters of phosphorus-containing acids (e.g., tricresyl phosphate, trioctyl phosphate, diethyl ester of decylphosphonic acid) and polymeric tetrahydrofurans.

Unrefined, refined and rerefined oils can be used in the coolant fluid compositions useful for the purposes of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art. Rerefined oils are obtained by processes similar to those used to obtain refined oils applied to refined oils which have been already used in service. Such rerefined oils are also known as reclaimed or reprocessed oils and often are additionally processed by techniques for removal of spent additives and oil breakdown products.

Component (B) of the oleaginous coolant fluid compositions useful for the purposes of this invention include the following:

1. one or more basic metal salts of organic acids;
2. one or more phosphorus containing metal salts;
3. one or more phenolic anti-oxidants; and mixtures of two or more of these compositions.

In general, Component (B) used in the coolant fluid compositions of this invention include materials known to those skilled in the art and have been described in numerous books, articles and patents. A number of these are noted hereinbelow in relation to specific types of compositions useful as Component (B) and where this is done it is to be understood that they are incorporated by reference for their disclosures relevant to the subject matter discussed at the point in the specification in which they are identified.

(B)(1) The Basic Metal Salts of Organic Acids

The choice of metal used to make these salts is usually not critical and therefore virtually any metal can be used. For reasons of availability, cost and maximum effectiveness, certain metals are more commonly used. These include the alkali and alkaline earth metals (i.e., the Group IA and IIA metals excluding francium and radium). Group IIB metals as well as polyvalent metals such as aluminum, chromium, molybdenum, wolfram, manganese, iron, cobalt, nickel, and copper can also be used. Salts containing a mixture of ions of two or more of these metals are often used.

These basic salts contain an excess of metal cation and are often termed overbased, hyperbased or superbased salts.

These basic salts can be of oil-soluble organic sulfur acids such as sulfonic, sulfamic, thiosulfonic, sulfinic, sulfenic, partial ester sulfuric, sulfurous and thiosulfuric acid. Generally they are salts of carbocyclic or aliphatic sulfonic acids.

The carbocyclic sulfonic acids include the mono- or poly-nuclear aromatic or cycloaliphatic compounds. The oil-soluble sulfonates can be represented for the most part by the following formulae:

$$[R'_x-T-(SO_3)_y]_zM_b \qquad \text{Formula I}$$

$$[R''-(SO_3)_a]_dM_b \qquad \text{Formula II}$$

In the above formulae, M is either a metal cation as described hereinabove or hydrogen; T is a cyclic nucleus such as, for example, benzene, naphthalene, anthracene, phenanthrene, diphenylene oxide, thianthrene, phenothioxine, diphenylene sulfide, phenothiazine, diphenyl oxide, diphenyl sulfide, diphenylamine, cyclohexane, petroleum naphthenes, decahydro-naphthalene, cyclopentane, etc.; R′ in Formula I is an aliphatic group such as alkyl, alkenyl, alkoxy, alkoxyalkyl, carboalkoxyalkyl, etc.; x is at least 1, and $R'_x+T$ contains a total of at least about 15 carbon atoms. R″ in Formula II is an aliphatic radical containing at least about 15 carbon atoms and M is either a metal cation or hydrogen. Examples of types of the R″ radical are alkyl, alkenyl, alkoxyalkyl, carboalkoxyalkyl, etc. Specific examples of R″ are groups derived from petrolatum, saturated and unsaturated paraffin wax, and polyolefins, including polymerized $C_2$, $C_3$, $C_4$, $C_5$, $C_6$, etc., olefins containing from about 15 to 7000 or more carbon atoms. The groups T, R′, and R″ in the above formulae can also contain other inorganic or organic substituents in addition to those enumerated above such as, for example, hydroxy, mercapto, halogen, nitro, amino, nitroso, sulfide, disulfide, etc. In Formula I, x, y, z and b are at least 1, and likewise in Formula II, a, b and d are at least 1.

The following are specific examples of oil-soluble sulfonic acids coming within the scope of Formulae I and II above, and it is to be understood that such examples serve also to illustrate the salts of such sulfonic acids useful for the purposes of this invention. In other words, for every sulfonic acid enumerated it is intended that the corresponding basic metal salts thereof are also understood to be illustrated. Such sulfonic acids; sulfonic acids derived from lubricating oil fractions having a Saybolt viscosity from about 100 seconds at 100° F. to about 200 seconds at 210° F.; petrolatum sulfonic acids; mono- and poly-wax substituted sulfonic and polysulfonic acids of, e.g., benzene, naphthalene, phenol, diphenyl ether, naphthalene disulfide, diphenylamine, thiophene, alpha-chloronaphthalene, etc.; other substituted sulfonic acids such as alkyl benzene sulfonic acids (where the alkyl group has at least 8 carbons), cetylphenol mono-sulfide sulfonic acids, dicetyl thianthrene disulfonic acids, dilauryl beta naphthyl sulfonic acids, dicapryl nitronaphthalene sulfonic acids, and alkaryl sulfonic acids such as dodecyl benzene "bottoms" sulfonic acids.

The latter are acids derived from benzene which has been alkylated with propylene tetramers or isobutene trimers to introduce 1, 2, 3, or more branched-chain $C_{12}$ substituents on the benzene ring. Dodecyl benzene bottoms, principally mixtures of mono- and di-dodecyl benzenes, are available as by-products from the manufacture of household detergents. Similar products obtained from alkylation bottoms formed during manufacture of linear alkyl sulfonates (LAS) are also useful in making the sulfonates used in this invention.

The production of sulfonates from detergent manufacture by-products by reaction with, e.g., $SO_3$, is well known to those skilled in the art. See, for example, the article "Sulfonates" in Kirk-Othmer "Encyclopedia of Chemical Technology", Second Edition, Vol. 19, pp. 291 et seq. published by John Wiley & Sons, N.Y. (1969).

Other descriptions of basic sulfonate salts and techniques for making them can be found in the following U.S. Pat. Nos. 2,616,905; 3,027,325; 3,312,618; 3,350,308; 3,471,403; 3,488,284; 3,595,790; 3,798,012; 3,829,381; and 4,326,972. These are hereby incorporated by reference for their disclosures in this regard.

Also included are aliphatic sulfonic acids such as paraffin wax sulfonic acids, unsaturated paraffin wax sulfonic acids, hydroxy-substituted paraffin wax sulfonic acids, hexapropylene sulfonic acids, tetra-amylene sulfonic acids, polyisobutene sulfonic acids wherein the polyisobutene contains from 20 to 7000 or more carbon atoms, chloro-substituted paraffin wax sulfonic acids, nitro-paraffin wax sulfonic acids, etc.; cycloaliphatic sulfonic acids such as petroleum naphthene sulfonic acids, cetyl cyclopentyl sulfonic acids, lauryl cyclohexyl sulfonic acids, bis-(di-isobutyl)cyclohexyl sulfonic acids, mono- or poly-wax substituted cyclohexyl sulfonic acids, etc.

With respect to the sulfonic acids or salts thereof described herein and in the appended claims, it is intended herein to employ the term "petroleum sulfonic acids" or "petroleum sulfonates" to cover all sulfonic acids or the salts thereof derived from petroleum products. A particularly valuable group of petroleum sulfonic acids are the mahogany sulfonic acids (so called because of their reddish-brown color) obtain as a by-product from the manufacture of petroleum white oils by a sulfuric acid process.

Generally Group IA, IIA and IIB basic salts of the above-described synthetic and petroleum sulfonic acids are useful in the practice of this invention.

The carboxylic acids from which suitable basic salts for use in this invention can be made include aliphatic, cycloaliphatic, and aromatic mono- and polybasic carboxylic acids such as the naphthenic acids, alkyl- or alkenyl-substituted cyclopentanoic acids, alkyl- or alkenyl-substituted cyclohexanoic acids, alkyl- or alkenyl-substituted aromatic carboxylic acids. The aliphatic acids generally contain at least eight carbon atoms and preferably at least twelve carbon atoms. Usually they have no more than about 400 carbon atoms. Generally, if the aliphatic carbon chain is branched, the acids are more oil-soluble for any given carbon atoms content. The cycloaliphatic and aliphatic carboxylic acids can be saturated or unsaturated. Specific examples include 2-ethylhexanoic acid, α-linoleic acid, propylene-tetramer-substituted maleic acid, behenic acid, isostearic acid, pelargonic acid, capric acid, palmitoleic acid, linoleic acid, lauric acid, oleic acid, ricinoleic acid, undecylic acid, dioctylcyclopentane carboxylic acid, myristic acid, dilauryldecahydronaphthalene carboxylic acid, stearyl-octahydroindene carboxylic acid, palmitic acid, commercially available mixtures of two or more carboxylic acids such as tall oil acids, rosin acids, and the like.

A preferred group of oil-soluble carboxylic acids useful in preparing the salts used in the present invention are the oil-soluble aromatic carboxylic acids. These acids are represented by the general formula:

Formula III $$(R^*)_a-(Ar^*)-\left(\overset{X}{\overset{\|}{C}}-XH\right)_m$$

where R* is an aliphatic hydrocarbon-based group of at least four carbon atoms, and no more than about 400 aliphatic carbon atoms, a is an integer of from one to four, Ar* is a polyvalent aromatic hydrocarbon nucleus of up to about 14 carbon atoms each X is independently a sulfur or oxygen atom, and m is an integer of from one to four with the proviso that R* and a are such that there is an average of at least 8 aliphatic carbon atoms provided by the R* groups for each acid molecule represented by Formula III. Examples of aromatic nuclei represented by the variable Ar* are the polyvalent aromatic radicals derived from benzene, naphthalene, anthracene, phenanthrene, indene, fluorene, biphenyl, and the like. Generally, the radical represented by Ar* will be a polyvalent nucleus derived from benzene or naphthalene such as phenylenes and naphthylene, e.g., methylphenylenes, ethoxyphenylenes, nitrophenylenes, isopropylphenylenes, hydroxyphenylenes, mercaptophenylenes, N,N-diethylaminophenylenes, chlorophenylenes, dipropoxynaphthylenes, triethylnaphthylenes, and similar tri-, tetra-, pentavalent nuclei thereof, etc.

The R* groups are usually purely hydrocarbyl groups, preferably groups such as alkyl or alkenyl radicals. However, the R* groups can contain small number substituents such as phenyl, cycloalkyl (e.g., cyclohexyl, cyclopentyl, etc.) and nonhydrocarbon groups such as nitro, amino, halo (e.g., chloro, bromo, etc.), lower alkoxy, lower alkyl mercapto, oxo substituents (i.e.,=O), thio groups (i.e.,=S), interrupting groups such as —NH—, —O—, —S—, and the like provided the essentially hydrocarbon character of the R* group is retained. THe hydrocarbon character is retained for purposes of this invention so long as any non-carbon atoms present in the R* groups do not account for more than about 10% of the total weight of the R* groups.

Examples of R* groups include butyl, isobutyl, pentyl, octyl, nonyl, dodecyl, docosyl, tetracontyl, 5-chlorohexyl, 4-ethoxypentyl, 4-hexenyl, 3-cyclohexyloctyl, 4-(p-chlorophenyl)-octyl, 2,3,5-trimethylheptyl, 4-ethyl-5-methyloctyl, and substituents derived from polymerized olefins such as polychloroprenes, polyethylenes, polypropylenes, polyisobutylenes, ethylene-propylene copolymers, chlorinated olefin polymers, oxidized ethylene-propylene copolymers, and the like. Likewise, the group Ar* may contain non-hydrocarbon substitutents, for example, such diverse substituents as lower alkoxy, lower alkyl mercapto, nitro, halo, alkyl or alkenyl groups of less than four carbon atoms, hydroxy, mercapto, and the like.

A group of particularly useful carboxylic acids are those of the formula:

Formula IV

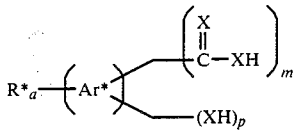

where R*, X, Ar*, m and a are as defined in Formula III and p is an integer of 1 to 4, usually 1 or 2. Within this group, an especially preferred class of oil-soluble carboxylic acids are those of the formula:

Formula V

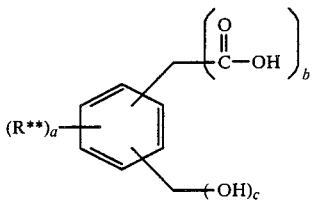

where R in Formula V is an aliphatic hydrocarbon group containing at least 4 to about 400 carbon atoms, a is an integer of from 1 to 3, b is 1 or 2, c is zero, 1, or 2 and preferably 1 with the proviso that R and a are such that the acid molecules contain at least an average of about twelve aliphatic carbon atoms in the aliphatic hydrocarbon substituents per acid molecule. And within this latter group of oil-soluble carboxylic acids, the aliphatic-hydrocarbon substituted salicyclic acids wherein each aliphatic hydrocarbon substituent contains an average of at least about sixteen carbon atoms per substituent and one to three substituents per molecule are particularly useful. Salts prepared from such salicylic acids wherein the aliphatic hydrocarbon substituents are derived from polymerized olefins, particularly polymerized lower 1-mono-olefins such as polyethylene, polypropylene, polyisobutylene, ethylene/propylene copolymers and the like and having average carbon contents of about 30 to about 400 carbon atoms.

The carboxylic acids corresponding to Formulae III–IV above are well known or can be prepared according to procedures known in the art. Carboxylic acids of the type illustrated by the above formulae and processes for preparing their neutral and basic metal salts are well known and disclosed, for example, in such U.S. Pat. Nos. 2,197,832; 2,197,835; 2,252,662; 2,252,664; 2,714,092; 3,410,798 and 3,595,791.

Another type of basic carboxylate salt used in this invention are those derived from alkenyl succinates of the general formula Formula VI

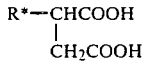

wherein R* is as defined above in Formula III. Such salts and means for making them are set forth in U.S. Pat. Nos. 3,271,130; 3,567,637 and 3,632,510, which are hereby incorporated by reference in this regard.

Other patents specifically describing techniques for making basic salts of the hereinabove-described sulfonic acids, carboxylic acids, and mixtures of any two or more of these include U.S. Pat. Nos. 2,501,731; 2,616,904; 2,616,905; 2,616,906; 2,616,911; 2,616,924; 2,616,925; 2,617,049; 2,777,874; 3,027,325; 3,256,186; 3,282,835; 3,384,585; 3,373,108; 3,365,396; 3,342,733; 3,320,162; 3,312,618; 3,318,809; 3,471,403; 3,488,284; 3,595,790; and 3,629,109. The disclosures of these patents are hereby incorporated by reference in this present specification for their disclosures in this regard as well as for their disclosure of specific suitable basic metal salts.

Usually the basic salts will be sodium, lithium, magnesium, calcium, or barium salts including mixtures of two or more of any of these.

(B)(2) Phosphorus Containing Metal Salts

The phosphorus-containing metal salts suitable for use as Component (B)(2) include metal salts of the Group I metals, the Group II metals, aluminum, tin, cobalt, lead, molybdenium, manganese and nickel, as well as mixtures of two or more of these metals. The preferred salts are those of zinc and cadmium and particularly preferred are the salts from zinc.

The preferred phosphorus-containing metal salts useful as component (B)(2) include (B)(2)(a) metal salts of one or more phosphorus-containing acids of the formula

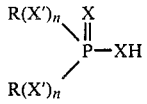

wherein each X and X' is independently oxygen or divalent sulfur with the proviso that each n may be zero or one, each R is independently the same or a different hydrocarbon-based radical;

(B)(2)(b) metal salts of the mixture of (i) one or more phosphorus-containing acids of the formula

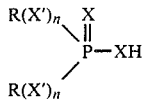

wherein X, X', R and n are defined in (B)(2)(a); and (ii) one or more aliphatic or alicyclic carboxylic acids; and (B)(2)(c) one or more compositions which are phosphite treatments of (B)(2)(a) or (B)(2)(b).

The phosphorus-containing metal salts (B)(2)(a) are those metal salts of one or more phosphorus-containing acids of the formula Formula VII

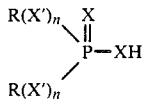

wherein each X and X' is independently oxygen or divalent sulfur with the proviso that each n may be 0 or 1, each R is independently the same or a different hydrocarbon-based radical.

Typical phosphorus-containing acids of Formula VII from which the coolant fluid compositions useful for the purposes of this invention can be made are known. Illustrative examples of some preferred phosphorus- and sulfur-containing acids are:

1. Dihydrocarbyl phosphinodithioic acids, such as amylphosphinodithioic acid, corresponding to the formula,

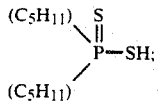

2. S-hydrocarbyl hydrogen hydrocarbylphosphonotrithioates, such as S-amyl hydrogen amylphosphonotrithioate, corresponding to the formula,

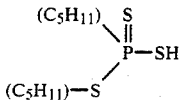

3. O-hydrocarbyl hydrogen hydrocarbylphosphonodithioates, such as O-amyl hydrogen amylphosphonodithioate, corresponding to the formula,

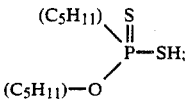

4. S,S-dihydrocarbyl hydrogen phosphorotetrathioates, such as diamyl hydrogen phosphorotetrathioate, corresponding to the formula,

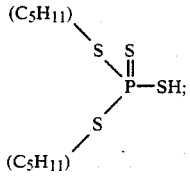

5. O,S-dihydrocarbyl hydrogen phosphorotrithioates, such as O,S-diamyl hydrogen phosphorotrithioate, corresponding to the formula,

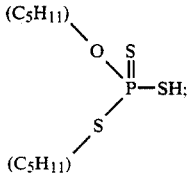

6. O,O-dihydrocarbyl hydrogen phosphorodithioates, such as O,O-diamyl hydrogen phosphorodithioate, corresponding to the formula,

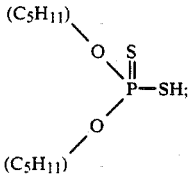

Preferred acids of the formla

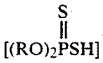

are readily obtainable from the reaction of phosphorus pentasulfide ($P_2S_5$) and an alcohol or a phenol. The reaction involves mixing at a temperature of about 20° to about 200° C., 4 moles of the alcohol or a phenol with one mole of phosphorus pentasulfide. Hydrogen sulfide is liberated in this reaction. The oxygen-containing analogs of these acids are conveniently prepared by treating the dithioic acid with water or steam which, in effect, replaces one or both of the sulfur atoms in the dithioic acid group.

Thus, as previously mentioned, the preferred phosphorus-containing acids are phosphorus- and sulfur-containing acids. These preferred acids more preferably include those of the above Formula VII wherein at least one X is sulfur, more preferably both of X are sulfur; at least one X′ is oxygen or sulfur, more preferably both of X′ are oxygen and n is 1. Mixtures of acids may be employed according to this invention.

The terminology of "hydrocarbon-based radical" as used herein, ("herein" includes the appended claims) is used to define a substantially saturated monovalent radical derived from a hydrocarbon by removal of a hydrogen from a carbon atom of the hydrocarbon. This carbon atom is directly connected to the remainder of the molecule. These hydrocarbon-based radicals are derived from aliphatic hydrocarbons, cyclo-aliphatic hydrocarbons, aromatic hydrocarbons, and mixed cyclo-aliphatic-aromatic hydrocarbons. Therefore, these hydrocarbon-based radicals would be referred to as aliphatic-based radicals, cyclo-aliphatic-based radicals, etc. The base hydrocarbons from which these radicals are derived may contain certain non-reactive or substantially non-reactive polar or non-hydrocarbon substituents.

The terminology "substantially saturated" as used herein is intended to define radicals free from acetylenic unsaturation —C≡C—) in which there is not more than one ethylenic linkage (—C=C—) for every 10 carbon-to-carbon (preferably 20) covalent bonds. The so-called "double bonds" in the aromatic ring (e.g., benzene) are not to be considered as contributing to unsaturation with respect to the terminology "substantially saturated". Usually there will be no more than an average of one ethylenic linkage per substantially saturated monovalent radical as described hereinbefore. Preferably, (with the exception of aromatic rings) all the carbon-to-carbon bonds in a substantially saturated radical will be saturated linkages; that is, the radical will be free from acetylenic and ethylenic linkages.

In general, the hydrocarbon-based radical of R may contain up to about 50 carbon atoms, generally contains from about 3 to about 50 carbon atoms with a preferred range of carbon atoms being from 3 to about 18. The hydrocarbon-based radicals may contain certain non-reactive or substantially non-reactive polar or non-hydrocarbon substituents which do not materially interfere with the reactions or compositions herein, as will be recognized by those skilled in the art. Representative non-hydrocarbon or polar substituents include halo substituents, such as chloro, fluoro, bromo and iodo; nitro; lower alkoxy, such as butoxy and hexyloxy; lower alkyl thio such as pentylthio and hepthylthio; hydroxy; mercapto;

$CO{-}$hydrocarbyl, e.g., $-\overset{O}{\overset{\|}{C}}{-}O-$ lower alkyl;

-continued

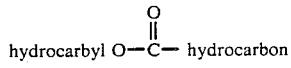

and the like. As a general rule, and particularly when the compositions useful for the purposes of this invention are to be used in combination with lubricating oil, the degree of substitution and nature of the substituent of the hydrocarbon-based radical is such that the predominantly hydrocarbon character of the radical is not destroyed. Thus, in view of this requirement, these radicals normally have no more than four substituents per radical, and usually, not more than one substituent for every 10 carbon atoms in the radical. Preferably, the hydrocarbon-based radical is a purely hydrocarbyl (i.e., a hydrocarbon radical containing only carbon and hydrogen atoms).

The term "lower" when used herein to denote radicals such as lower alkyl is intended to describe a radical containing up to seven carbon atoms.

Desirable compositions of this invention include those made from phosphorus-containing acids wherein each R is hydrocarbyl, particularly, independently alkyl, aryl, alkaryl and arylalkyl of up to about 50 carbon atoms, more preferably from about three to about 18 carbon atoms. The preferred R groups are alkyl and alkaryl, preferably alkyl.

ALso useful as Component (B)(2) are (B)(2)(b) metal salts of the mixture of (i) one or more phosphorus acids of Formula (VII) and (ii) one or more aliphatic or alicyclic carboxylic acids. Suitable metals from which these metal salts are obtained are defined hereinabove.

These carboxylic acids (B)(2)(b)(ii) may be a monocarboxylic or polycarboxylic acid, usually containing from 1 to about 3 carboxy groups and preferably only 1. It may contain from about 3 to about 40 and preferably from about 5 to about 20 carbon atoms.

The preferred carboxylic acids are those having the formula $R^2COOH$, wherein $R^2$ is an aliphatic or alicyclic hydrocarbon-based radical. Suitable acids include the butanoic, pentanoic, hexanoic, octanoic, nonanoic, decanoic, dodecanoic, octadecanoic and eicosanoic acids, as well as olefinic acids such as oleic, linoleic, and linolenic acids and linoleic acid dimer. For the most part, $R^2$ is a saturated aliphatic radical and especially a branched alkyl radical such as the isopropyl or 3-heptyl radical. Illustrative polycarboxylic acids are succinic, alkyl- and alkenylsuccinic, adipic, sebacic and citric acids.

The metal salts of the mixture of phosphorus and carboxylic acids (B)(2)(b) useful for the purposes of this invention may be prepared by merely blending a metal salt of (B)(2)(b)(i) one or more phosphorus acids of Formula VII with a metal salt of (B)(2)(b)(ii) one or more aliphatic or alicyclic carboxylic acid in the desired ratio. This ratio is between about 0.5:1 and about 4.5:1 on an equivalent weight basis. Most often, the ratio is between about 2.5:1 and about 4.25:1. For this purpose, the equivalent weight of a phosphorodithioic acid is its molecular weight divided by the number of -PSSH groups therein, and that of a carboxylic acid is its molecular weight divided by the number of carboxy groups therein.

A second and preferred method for preparing the metal salts of mixed acids (B)(2)(b) useful for the purpose of this invention is to prepare a mixture of the acids [(B)(2)(b)(i) one or more phosphorus acids of Formula VII and (B)(2)(b)(ii) one or more aliphatic or alicyclic carboxylic acids] in the desired ratio and to react the acid mixture with a suitable metal base. When this method of preparation is used, it is frequently possible to prepare a salt containing an excess of metal with respect to the number of equivalents of acid present; thus, mixed metal salts containing as many as 2 equivalents and especially up to about 1.5 equivalents of metal per equivalent of acid may be prepared. The equivalent of a metal for this purpose is its atomic weight divided by its valence.

Variants of the above-described methods may also be used to prepare the mixed metal salts of this invention. For example, a metal salt of component (B)(2)(b)(i) or (B)(2)(b)(ii) may be blended with the free carboxylic acid as component (B)(2)(b)(ii) or (B)(2)(b)(i) respectively, and the resulting blend reacted with additional metal base.

Suitable metal bases for the preparations of the metal salts (B)(2)(b) useful for the purposes of this invention include the free metals previously enumerated and their oxides, hydroxides, alkoxides and basic salts. Examples are sodium hydroxide, sodium methoxide, sodium carbonate, potassium hydroxide, potassium carbonate, magnesium oxide, magnesium hydroxide, calcium hydroxide, calcium acetate, zinc oxide, zinc acetate, lead oxide, nickel oxide and the like.

The temperature at which the metal salts useful for the purposes of this invention are prepared is generally between about 30° and about 150° C., preferably up to about 125° C. If these salts are prepared by neutralization of a mixture of acids with a metal base, it is preferred to employ temperatures above about 50° and especially above about 75°. It is frequently advantageous to conduct the reaction in the presence of a substantially inert, normally liquid organic diluent such as naphtha, benzene, xylene, mineral oil or the like. If the diluent is mineral oil or is physically and chemically similar to mineral oil, it frequently need not be removed before using these metal salts in coolant fluid compositions described herein.

The phosphorus-containing metal salts useful as Component (B)(2) may also be a salt composition wherein (B)(2)(a) or (B)(2)(b) has been treated by contacting the above described salt composition or their phosphorus acid precursors with a phosphite compound.

Phosphites useful for the purposes of this invention are preferably those of the formula $(R^4O)_3P$, wherein each $R^4$ is independently hydrogen or a hydrocarbon-based radical and at least one $R^4$ is a hydrocarbon-based radical.

Preferably, the hydrocarbon-based radicals present as $R^4$ in the phosphite compound have from about 1 to about 12 carbon atoms, desirably up to about 10 carbon atoms. The radicals are usually hydrocarbon and especially lower hydrocarbon. They are preferably lower alkyl or aryl radicals, most often lower aryl and especially phenyl.

The phosphite having the formula $(R^4O)_3P$ is preferably tertiary or secondary. That is, it may contain three or only two (respectively) hydrocarbon-based radicals per molecule. Secondary phosphites are generally considered to have a tautomeric structure:

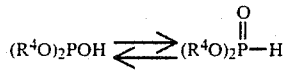

The tertiary phosphites are particularly preferred for use in the method of this invention.

As previously mentioned, the phosphite treatment may be effected either on the free phosphorus acid or on its salt. It is usually more convenient, and is frequently preferred, to treat the salt.

The phosphite treatment is conveniently effected by merely heating the phosphorus acid salt with the phosphite compound at a temperature typically between about 50° and about 200° C. and preferably between about 100° and about 150° C. The reaction may be carried out in a substantially inert, normally liquid organic diluent such as mineral oil, xylene or the like; if the diluent is mineral oil or is physically and chemically similar to mineral oil, it frequently need not be removed before using the product in coolant fluid composition described herein. The amount of phosphite used is generally between about 2 and about 20 parts, preferably between about 2 and about 10 parts, by weight per 100 parts of salt. If the free phosphorus acid is treated with the phosphite, the weight proportions thereof are adjusted to be equivalent to the desired level of treatment of the salt.

(B)(3) Phenolic Anti-oxidants

Compositions which are also useful as Component (B) in the coolant fluid compositions useful in the instant invention are phenolic anti-oxidants (B)(3). The phenolic anti-oxidant compositions suitable for use with regard to the instant invention are preferably hindered phenols and hindered bisphenols corresponding to the general formula

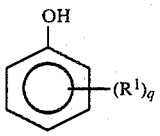

VIII

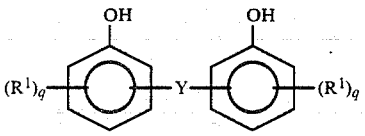

IX wherein said $R^1$ groups are each independently hydrogen or aliphatic hydrocarbon radicals containing from 1 to about 8 carbon atoms; q can be 1, 2 or 3 with the proviso that at least one of said $R^1$ groups is said aliphatic hydrocarbon radical in a position ortho to the phenolic hydroxyl group and wherein Y is a radical selected from the group consisting of alkylidene radicals containing from 1 to about 4 carbon atoms and thio (—S—) and dithio (—S—S—) radicals.

Herein, the term "hindered phenolic antioxidants" means phenolic antioxidants characterized by having at least one substituent in at least one position ortho to the phenolic hydroxyl group.

With respect to the hindered phenols and hindered bisphenols defined immediately above, the term "aliphatic hydrocarbon" means saturated alkyl and cycloalkyl hydrocarbons, and by the term "alkylidene radical" is meant divalent hydrocarbon radicals derived from alkyl radicals in which two hydrogen atoms are removed from the same carbon.

Among the hindered phenols and hindered bisphenols useful in preparing the coolant fluid compositions described herein the preferred phenols are those in which at least one of said $R^1$ groups in the formulae above is a branched-chain alkyl radical, especially at the alpha carbon in said radical, in a position ortho to the phenolic hydroxyl group. The preferred hindered phenols and hindered bisphenols are those wherein q is 2 or 3, particularly preferred are those where q is 2, and in which two of said R groups in the formula above are branched-chain alkyl radicals, especially at the alpha carbon in said radical, in both positions ortho to the phenolic hydroxyl group. Particularly preferred are hindered phenols and hindered bisphenols wherein $R^1$ contains from 1–4 carbon atoms.

Representative, but non-limited examples of hindered phenols and hindered bisphenols corresponding to the above formulae and useful in preparing the coolant fluid compositions used in this invention include 2-tert-butylphenol; 2-ethyl-6-methylphenol; 2,6-di-tert-butylphenol; 3-methyl-2,6-bis(1-methylethyl)phenol; 4-methyl-2,6-di-tert-butylphenol; 3-methyl-2,6-bis(1-methylpropyl)phenol; 2-butyl-6-ethylphenol; 4-butyl-2,6-di-tert-butylphenol; 4-tert-butyl-2,6-dimethylphenol; 6-tert-butyl-2,3-dimethylphenol; 2-tert-butyl-4-methylphenol; 2-cyclohexyl-6-tert-butylphenol; 2-cyclohexyl-6-tert-butyl-4-methylphenol; 2-tert-butyl-4,6-dimethylphenol; 2,2'-methylenebis(4,6-di-tert-butylphenol); 4,4'-methylenebis(2,6-di-tert-butylphenol); 2,2'-methylenebis[4,6-bis(1,1-dimethylpropyl)phenol]; 4,4'-methylenebis[2,6-bis(2-methylhexyl)phenol]; 3,3'-methylenebis(2,6-di-tert-butyl-4-methylphenol); 4,4'-propylidenebis(2-tert-butylphenol); 2,2'-propylidenebis(6-tert-butyl-4-methyl-phenol); 2,2'-ethylidenebis(4,6-di-tert-butylphenol); 4,4'-ethylidenebis(2,6-di-tert-butylphenol); 4,4'-ethylidenebis(2-tert-butyl-6-methylphenol); 2,2'-butylidenebis(4,6-di-tert-butylphenol); 4,4'-butylidenebis(2-tert-butyl-3-methylphenol); 4,4'-butylidenebis(2-tert-butyl-6-methylphenol); 2,4,6-tri-tert-butylphenol; 2,4,6-tris(1,1-dimethylbutyl)-phenol; 2,2'-thiobis(2,6-di-tert-butylphenol); 4,4'-thiobis(2,6-di-tert-butylphenol); 3,3'-thiobis(2,6-di-tert-butyl-4-methylphenol); 4,4'-(2-tert-butyl-6-methylphenol); 4,4'-dithiobis(2,6-di-tert-butylphenol); 4,4'-dithiobis(2,6-diisopropylphenol); 2,2'-dithiobis-(6-tert-butyl-4-methylphenol); 4,4'-dithiobis(2-tert-butyl-6-methylphenol) and the like.

The phenolic antioxidants described hereinabove can be employed either singularly or as mixtures of two or more of said phenolic antioxidants. Preferred phenolic antioxidants for use in preparing the compositions used in this invention include 2,6-di-tert-butyl-4-methylphenol; 2,6-di-tert-butylphenol; 2-tert-butylphenol; 4,4'-methylenebis(2,6-di-tert-butylphenol) and mixtures thereof.

Generally, the coolant fluid compositions useful for the purposes of the present invention are prepared by blending a minor amount of one or more compositions of Component (B) with a major amount of the lubricating oil of Component (A). Normally, the amount of each of the various additives used as Component (B) will be from about 0.05% up to about 10%, preferably from about 0.1% up to about 2.5% by weight of the total weight of the coolant fluid composition. Also, the total amount of the various additives used as Component (B) will typically not exceed about 10%, preferably from about 0.1% to about 2.5% by weight of the total weight of the coolant fluid compositions.

The term "minor amount" as used in the specification and appended claims is intended to mean that when a composition contains a "minor amount" of a specific material that amount is less than 50% by weight of the composition.

The term "major amount" as used in the specification and appended claims is intended to mean that when a composition contains a "major amount" of a specific material that amount is more than 50% by weight of the composition.

The invention also contemplates that the coolant fluid composition contain other additives in combination with those specifically provided hereinabove. Such additives include, for example, detergent and dispersants of the ash-producing or ashless type, corrosion- and oxidation-inhibiting agents, pour point depressing agents, extreme pressure agents, color stabilizers and anti-foam agents.

These additives are tradiational lubricating oil additives and are identified by their primary function in lubricating oils. However, while these additives may perform similar functions in the coolant fluid compositions described herein, their use and function as coolant fluid additives are not necessarily limited to those described by their names.

The ash-producing detergents are exemplified by oil-soluble neutral and basic salts of alkali or alkaline earth metals with sulfonic acids, carboxylic acids, or organic phosphorus acids characterized by at least one direct carbon-to-phosphorus linkage such as those prepared by the treatment of an olefin polymer (e.g., polyisobutene having a molecular weight of 1000) with a phosphorizing agent such as phosphorus trichloride, phosphorus heptasulfide, phosphorus pentasulfide, phosphorus trichloride and sulfur, white phosphorus and a sulfur halide, or phosphorothioic chloride. The most commonly used salts of such acids are those of sodium, potassium, lithium, calcium, magnesium, strontium and barium.

The term "basic salt" is used to designate metal salts wherein the metal is present in stoichiometrically larger amounts than the organic acid radical. The commonly employed methods for preparing the basic salts involve heating a mineral oil solution of an acid with a stoichiometric excess of a metal neutralizing agent such as the metal oxide, hydroxide, carbonate, bicarbonate, or sulfide at a temperature about 50° C. and filtering the resulting mass. The use of a "promoter" in the neutralization step to aid the incorporation of a large excess of metal likewise is known. Examples of compounds useful as the promoter include phenolic substances such as phenol, naphthol, alkylphenol, thiophenol, sulfurized alkylphenol, and condensation products of formaldehyde with a phenolic substance; alcohols such as methanol, 2-propanol, octyl alcohol, cellosolve, carbitol, ethylene glycol, steryl alcohol, and cyclohexyl alcohol; and amines such as aniline, phenylenediamine, phenothiazine, phenyl-$\beta$-naphthylamine, and dodecylamine. A particularly effective method for preparing the basic salts comprises mixing an acid with an excess of a basic alkaline earth metal neutralizing agent and at least one alcohol promoter, and carbonating the mixture at an elevated temperature such as 60°-200° C.

Ashless detergents and dispersants are so called despite the fact that, depending on its constitution, the dispersant may upon combustion yield a non-volatile material such as boric oxide or phosphorus pentoxide; however, it does not ordinarily contain metal and therefore does not yield a metal-containing ash on combustion. Many types are known in the art, and any of them are suitable for use in the coolant fluid compositions of this invention. The following are illustrative:

(1) Reaction products of carboxylic acids (or derivatives thereof) containing at least about 34 and preferably at least about 54 carbon atoms with nitrogen-containing compounds such as amine, organic hydroxy compounds such as phenols and alcohols, and/or basic inorganic materials. Examples of these ∓carboxylic dispersants" are described in British Pat. No. 1,306,529 and in many U.S. patents including the following U.S. Pat. Nos. 3,163,603; 3,184,474; 3,215,707; 3,219,666; 3,271,310; 3,272,746; 3,281,357; 3,306,908; 3,311,558; 3,316,177; 3,340,281; 3,341,542; 3,346,493; 3,351,552; 3,381,022; 3,399,141; 3,415,750; 3,433,744; 3,444,170; 3,448,048; 3,448,049; 3,451,933; 3,454,607; 3,467,668; 3,501,405; 3,522,179; 3,541,012; 3,542,678; 3,542,680; 3,567,637; 3,574,101; 3,576,743; 3,630,904; 3,632,510; 3,632,511; 3,697,428; 3,725,441; and Re. 26,433.

(2) Reaction products of relatively high molecular weight aliphatic or alicyclic halides with amines, preferably polyalkylene polyamines. These may be characterized as "amine dispersants" and examples thereof are described for example, in the following U.S. Pat. Nos. 3,275,554; 3,438,757; 3,454,555; and 3,565,804.

(3) Reaction products of alkyl phenols in which the alkyl group contains at least about 30 carbon atoms with aldehydes (especially formaldehyde) and amines (especially polyalkylene polyamines), which may be characterized as "Mannich dispersants". The materials described in the following U.S. patents are illustrative U.S. Pat. Nos. 2,459,112; 2,962,442; 2,984,550; 3,036,003; 3,166,516; 3,236,770; 3,355,270; 3,368,972; 3,413,347; 3,442,808; 3,448,047; 3,454,497; 3,459,661; 3,461,172; 3,493,520; 3,539,633; 3,558,743; 3,586,629; 3,591,598; 3,600,372; 3,634,515; 3,649,229; 3,697,574; 3,725,277; 3,725,480; 3,726,882; and 3,980,569.

(4) Products obtained by post-treating the carboxylic, amine or Mannich dispersants with such reagents as urea, thiourea, carbon disulfide, aldehydes, ketones, carboxylic acids, hydrocarbon-substituted succinic anhydrides, nitriles, epoxides, boron compounds, phosphorus compounds or the like. Exemplary materials of this kind are described in the following U.S. Pat. Nos. 3,036,003; 3,087,936; 3,200,107; 3,216,936; 3,254,025; 3,256,185; 3,278,550; 3,280,234; 3,281,428; 3,282,955; 3,312,619; 3,366,569; 3,367,943; 3,373,111; 3,403,102; 3,442,808; 3,455,831; 3,455,832; 3,493,520; 3,502,677; 3,513,093; 3,533,945; 3,539,633; 3,573,010; 3,579,450; 3,591,598; 3,600,372; 3,639,242; 3,649,229; 3,649,659; 3,658,836; 3,697,574; 3,702,757; 3,703,536; 3,704,308; and 3,708,522.

(5) Interpolymers of oil-solubilizing monomers such as decyl methacrylate, vinyl decyl ether and high molecular weight olefins with monomers containing polar substituents, e.g., aminoalkyl acrylates or acrylamides and poly-(oxyethylene)-substituted acrylates. These may be characterized as "polymeric dispersants" and examples thereof are disclosed in the following U.S. Pat. Nos. 3,329,658; 3,449,250; 3,519,565; 3,666,730; 3,687,849; and 3,702,300.

The above-noted patents are incorporated by reference herein for their disclosures of ashless dispersants.

Extreme pressure agents and corrosion- and oxidation-inhibiting agents are exemplified by chlorinated aliphatic hydrocarbons such as chlorinated wax; organic sulfides and polysulfides such as benzyl disulfide, bis(chlorobenzyl)disulfide, dibutyl tetrasulfide, sulfurized methyl ester of oleic acid, sulfurized alkylphenol, sulfurized dipentene, and sulfurized terpene; phosphosulfurized hydrocarbons such as the reaction product of a phosphorus sulfide with turpentine or methyl oleate, phosphorus esters including principally dihydrocarbon and trihydrocarbon phosphites such as dibutyl phosphite, diheptyl phosphite, dicyclohexyl phosphite, pentylphenyl phosphite, dipentylphenyl phosphite, tridecyl phosphite, distearyl phosphite, dimethyl naphthyl phosphite, oleyl 4-pentylphenyl phosphite, polypropylene (molecular weight 500)-substituted phenyl phosphite, diisobutyl-substituted phenyl phosphite; metal thiocarbamates, such as zinc dioctyldithiocarbamate, and barium heptylphenyl dithiocarbamate; Group II metal phosphorodithioates such as zinc dicyclohexylphosphorodithioate, zinc dioctylphosphorodithioate, barium di(heptylphenyl)-phosphorodithioate, cadmium dinonylphosphorodithioate, and the zinc salt of a phosphorodithioic acid produced by the reaction of phosphorus pentasulfide with an equimolar mixture of isopropyl alcohol and n-hexyl alcohol.

Pour point depressants are a particularly useful type of additives often included in the coolant fluid compositions described herein. The use of such pour point depressants in oil-based compositions to improve low temperature properties of oil-based compositions is well known in the art. See, for example, "Lubricant Additives" by C. V. Smalheer and R. Kennedy Smith (Lezius-Hiles Co. publishers, Cleveland, Ohio, 1967), page 8. With respect to the instant invention, pour point depressants permit the flow of the coolant fluid composition through the engine's cooling system during cold weather start-up conditions.

Examples of useful pour point depressants are polymethacrylates, polyacrylates; polyacrylamides; condensation products of haloparaffin waxes and aromatic compounds; vinyl carboxylate polymers; and terpolymers of dialkylfumarates, vinylesters of fatty acids and alkyl vinylethers.

Pour point depressants useful for the purposes of this invention, techniques for their preparation and their uses are described in U.S. Pat. Nos. 2,387,501; 2,015,748; 2,655,479; 1,815,022; 2,191,498; 2,666,746; 2,721,877; 2,721,878; and 3,250,715 which are hereby incorporated by reference for their relevant disclosures.

The oleaginous coolant fluid compositions useful for the purposes of this invention are exemplified by the following example:

EXAMPLE A

| | Ingredients | parts-by-weight |
|---|---|---|
| 1 | Lubricating oil - 100 neutral solvent refined mineral oil having a viscosity of 19.9 cSt at 40° C. and 4.26 cSt at 100° C., a VI of 105 and pour point of −18° C. | 98.406 |
| 2 | Triphenyl phosphite post treateed zinc salt of a mixture of di-2-ethylhexyl phosphorodithio and 2-ethylhexyl carboxylic acid | 0.53 |
| 3 | Sodium overbased alkyl benzene sulfonate having a metal ratio of 20. | 0.106 |

EXAMPLE A-continued

| | Ingredients | parts-by-weight |
|---|---|---|
| 4 | A commercially available hindered phenol anti-oxidant which is predominately a mixture of di and tri-t-butyl phenols | 0.178 |
| 5 | A commercially available polyalkylene glycoloxyalkylate demulsifier composition. | 0.01 |
| 6 | A commercially available silicone anti-foam agent. | 0.01 |
| 7 | Pour point depressant terpolymer of di-$C_{12-14}$ alkylfumarate/vinyl acetate/ethyl vinylether. | 0.50 |
| 8 | A commercially available pour point depressant which is a chlorinated paraffin wax - naphthalene condensate. | 0.25 |

As previously mentioned, the instant invention relates to a method for cooling an internal combustion engine. This is accomplished by filling the cooling system of an internal combustion engine with the coolant fluid compositions described hereinabove and then circulating the coolant fluid within the cooling system of said engine during its operation. While the instant invention may be applied to all internal combustion engines which use a coolant fluid system to remove excess heat during its operation, the method is particularly applicable to use in diesel engines.

The coolant fluid composition described in Example A was added to the cooling system of two diesel engine powered trucks, Mack V6, 275HP Econodyne trucks, and performed satisfactorily when the trucks were driven for a total of approximately 65,000 miles of over the road highway driving.

What is claimed is:

1. A method for cooling a conventional water-cooled internal combustion engine which comprises circulating within the water coolant system of said engine an oleaginous coolant fluid composition essentially free from water and comprising:

(A) a major amount of a lubricating oil having a kinematic viscosity of from about 3.5 up to about 5 cSt at 100° C. and from about 18 up to about 30 cSt at 40° C.;

(B) a minor amount of a composition selected from the group consisting of
  (1) one or more basic metal salts of organic acids;
  (2) one or more phosphorus containing metal salts;
  (3) one or more phenolic antioxidants;
  (4) one or more pour point depressants; and mixtures of two or more of (B)(1) through (B)(4).

2. A method according to claim 1 wherein component (B) is a composition comprising
  (1) one or more basic metal salts of organic acids;
  (2) one or more phosphorus-containing metal salts selected from the group consisting of
    (a) metal salts of one or more phosphorus-containing acids of the formula

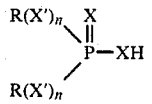

wherein each X and X′ is independently oxygen or divalent sulfur with the proviso that each n may be zero or one, each R is independently the same or a different hydrocarbon-based radical;

(b) metal salts of the mixture of (i) one or more phosphorus-containing acids of the formula

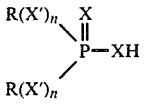

wherein X, X', R and n are defined in (B)(2)(a); and (ii) one or more aliphatic or alicyclic carboxylic acids; and (c) one or more compositions which are phosphite post-treatments of (B)(2)(a) or (B)(2)(b); and (3) one or more phenolic antioxidants selected from the group consisting of hindered phenols and hindered phenols corresponding to the formulae:

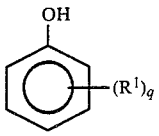

(a)

and

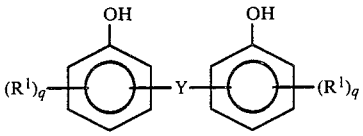

(b)

wherein said $R^1$ groups are each independently hydrogen or aliphatic hydrocarbon radicals containing from 1 to about 8 carbon atoms; q can be 1, 2 or 3 with the proviso that at least one of said $R^1$ groups is an aliphatic hydrocarbon radical in a position ortho to the phenolic hydroxyl group and Y is a radical selected from the group consisting of alkylidene radicals containing from 1 to about 4 carbon atoms, thio radicals and dithio radicals.

3. A method according to claim 2 wherein the organic acid of (B)(1) is an organic sulfur acid.

4. A method according to claim 3 wherein the basic metal salts of (B)(1) are alkali and alkaline earth metal salts of carbocyclic or aliphatic sulfonic acids.

5. A method according to claim 3 wherein at least one X of (B)(2) is divalent sulfur, at least one X' of (B)(2) is oxygen and n of (B)(2) is one.

6. A method according to claim 5 wherein the phosphorus-containing metal salts of (B)(2) are Group II metal salts.

7. A method according to claim 6 wherein the phenolic antioxidant of (B)(3) corresponds to the formula

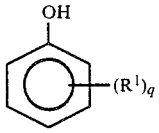

wherein $R^1$ is an alkyl radical containing 1–4 carbon atoms and q is 2 or 3.

8. A method according to claim 6 wherein X' is oxygen, X is divalent sulfur and n is 1.

9. A method according to claim 8 wherein the Group II metal is zinc or cadmium.

10. A method according to claim 9 wherein each R is an alkyl radical having from 3 to about 50 carbon atoms.

11. A method according to claim 10 wherein each R contains from about 3 to about 18 carbon atoms.

12. A method according to claim 11 wherein the carboxylic acid has the formula $R^2COOH$, wherein $R^2$ is an aliphatic hydrocarbon-based radical.

13. A method according to claim 12 wherein the carboxylic acid contains from 3 to about 40 carbon atoms.

14. A method according to claim 13 wherein $R^2$ is a branched alkyl radical containing about 4 to about 20 carbon atoms.

15. A method according to claim 6 wherein the phosphite is of the formula $(R^4O)_3P$, wherein each $R^4$ is a hydrocarbon-based radical.

16. A method according to claim 14 wherein each $R^4$ contains from about 3 to about 18 carbon atoms.

17. A method for cooling a conventional water-cooled internal combustion engine which comprises circulating within the water coolant system of said engine an oleaginous coolant fluid composition essentially free from water and comprising:

(A) a major amount of a lubricating oil having a kinematic viscosity of about 4.0–4.3 cSt at 100° C. and about 19–22 cSt at 40° C.;

(B)(1) a minor amount of one or more basic alkali or alkaline earth metal salts of organic sulfonic acids, carboxylic acids or mixtures thereof;

(B)(2) a minor amount of one or more phosphite post-treatment compositions of zinc or cadmium metal salts of the mixture of (i) one or more phosphorus-containing acids of the formula

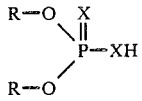

wherein each X is independently oxygen or divalent sulfur, each R is independently an alkyl radical containing from about 3 to about 18 carbon atoms; and (ii) one or more carboxylic acids having the formula $R^2COOH$, wherein $R^2$ is an aliphatic hydrocarbon-based radical;

(B)(3) a minor amount of one or more phenolic antioxidants having the formula

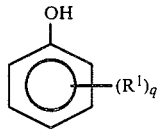

wherein each $R^1$ is independently an alkyl radical containing 1–4 carbon atoms; q is 2 or 3 with the proviso that said $R^1$ radicals are in both positions ortho to the phenolic hydroxyl group;

(B)(4) a minor amount of one or more pour point depressants;

(B)(5) a minor amount of one or more demulsifier compositions; and (B)(6) a minor amount of one or more antifoam compositions; with the proviso that components (B)(1) through (B)(6) constitute from about 0.05 up to about 2.5% by weight of said coolant fluid composition.

* * * * *